US011111636B2

(12) United States Patent
Sawyer et al.

(10) Patent No.: US 11,111,636 B2
(45) Date of Patent: Sep. 7, 2021

(54) BASE FOR TURF SYSTEM WITH VERTICAL SUPPORT EXTENSIONS AT PANEL EDGES

(71) Applicant: Brock USA, LLC, Boulder, CO (US)

(72) Inventors: Daniel C. Sawyer, Boulder, CO (US); Richard R. Runkles, Windsor, CO (US); James M. Koerlin, Broomfield, CO (US)

(73) Assignee: Brock USA, LLC, Boulder, CO (US)

( * ) Notice: Subject to any disclaimer, the term of this patent is extended or adjusted under 35 U.S.C. 154(b) by 0 days.

(21) Appl. No.: 16/667,072

(22) Filed: Oct. 29, 2019

(65) Prior Publication Data

US 2020/0063379 A1 Feb. 27, 2020

Related U.S. Application Data

(63) Continuation of application No. 16/114,858, filed on Aug. 28, 2018, now Pat. No. 10,458,075, which is a continuation of application No. 15/157,528, filed on May 18, 2016, now Pat. No. 10,060,082.

(51) Int. Cl.

| | |
|---|---|
| ***E01C 13/02*** | (2006.01) |
| ***E02B 11/00*** | (2006.01) |
| ***E01C 13/08*** | (2006.01) |
| ***A41G 1/00*** | (2006.01) |

(52) U.S. Cl.

CPC ..... *E01C 13/02* (2013.01); *A41G 1/009* (2013.01); *E01C 13/08* (2013.01); *E02B 11/00* (2013.01); *E01C 13/083* (2013.01); *Y10T 428/16* (2015.01); *Y10T 428/17* (2015.01)

(58) Field of Classification Search

CPC ..... E01C 13/02; E01C 13/08; E10C 13/083; A41G 1/009; E02B 11/00; Y10T 428/16; Y10T 428/17

See application file for complete search history.

(56) References Cited

U.S. PATENT DOCUMENTS

| | | | | |
|---|---|---|---|---|
| 10,060,082 | B2 * | 8/2018 | Sawyer | E01C 13/02 |
| 10,458,075 | B2 * | 10/2019 | Sawyer | E01C 13/02 |
| 2008/0176010 | A1 * | 7/2008 | Sawyer | E01C 3/003 428/27 |

* cited by examiner

*Primary Examiner* — David Sample
*Assistant Examiner* — Donald M Flores, Jr.
(74) *Attorney, Agent, or Firm* — MacMillan, Sobanski & Todd, LLC

(57) ABSTRACT

An underlayment layer is configured to support an artificial turf assembly. The underlayment layer comprises plurality of panels, each panel comprising a core with a top side and a bottom side. The top side has a plurality of top projections. The top projections form top side water drainage channels. The panels have edges, with the edges of one panel abutting the edges of adjacent panels, thereby forming a drainage path between adjacent panels. The panel edges have vertical support extensions that extend into the drainage paths between adjacent panels. The vertical support extensions have an upper surface for supporting an artificial turf assembly overlying the turf underlayment layer, and the panel edges having one or more complementary indentations corresponding to vertical support extensions of adjacent panels. When the panels move toward each other, thereby closing drainage paths between adjacent panels, the vertical support extensions are received in the corresponding indentations.

20 Claims, 5 Drawing Sheets

BASE FOR TURF SYSTEM WITH VERTICAL SUPPORT EXTENSIONS AT PANEL EDGES

CROSS-REFERENCE TO RELATED APPLICATIONS

This application is a continuation patent application of U.S. patent application Ser. No. 16/114,858, filed Aug. 28, 2018; now U.S. Pat. No. 10,458,075, issued Oct. 29, 2019. U.S. patent application Ser. No. 16/114,858 is a continuation patent application of U.S. patent application Ser. No. 15/157,528, filed May 18, 2016; now U.S. Pat. No. 10,060,082, issued Aug. 28, 2018. The disclosure of these applications are incorporated herein by reference in their entirety.

TECHNICAL FIELD

This invention relates in general to artificial turf systems of the type used in athletic fields, ornamental lawns and gardens, and playgrounds.

BACKGROUND OF THE INVENTION

Artificial turf systems are commonly used for sports playing fields and more particularly to artificial playing fields. Artificial turf systems can also be used for synthetic lawns and golf courses, rugby fields, playgrounds, and other similar types of fields or floor coverings. Artificial turf systems typically comprise a turf assembly and a foundation, which can be made of such materials as asphalt, graded earth, compacted gravel or crushed rock. Optionally, an underlying resilient base or underlayment layer may be disposed between the turf assembly and the foundation. The turf assembly is typically made of strands of plastic artificial grass blades attached to a turf backing. An infill material, which typically is a mixture of sand and ground rubber particles, may be applied among the vertically oriented artificial grass blades, typically covering the lower half or ⅔ of the blades.

SUMMARY OF THE INVENTION

This invention relates to a turf underlayment layer configured to support an artificial turf assembly. The underlayment layer comprises plurality of panels, each panel comprising a core with a top side and a bottom side. The top side has a plurality of top projections. The top projections form top side water drainage channels. The panels have edges, with the edges of one panel abutting the edges of adjacent panels, thereby forming a drainage path between adjacent panels. The panel edges have vertical support extensions that extend into the drainage paths between adjacent panels. The vertical support extensions have an upper surface for supporting an artificial turf assembly overlying the turf underlayment layer, and the panel edges having one or more complementary indentations corresponding to vertical support extensions of adjacent panels. When the panels move toward each other, thereby closing drainage paths between adjacent panels, the vertical support extensions are received in the corresponding indentations.

According to this invention, there is also provided a turf underlayment layer for supporting an artificial turf assembly. The turf underlayment layer includes a plurality of panels assembled together. Each panel includes a core, a top side having a plurality of projections, and a bottom side, the top projections forming top side water drainage channels. The panels have edges, with the edges of one panel abutting the edges of adjacent panels. The panel edges have a non-linear shape, with the non-linear shape of the panel edges being complementary to the non-linear, non-interlocking shape of adjacent panel edges. At least one of the panel edges has one or more drainage projections, the drainage projections spacing the abutting panel edges apart, with the resultant spacing of the edges of abutting panels forming a drainage path at the intersection of the abutting panels. The drainage paths are non-linear because of the non-linear shape of the panel edges.

According to this invention, there is also provided a turf underlayment panel suitable for assembly with additional turf underlayment panels to form a turf underlayment layer for supporting an artificial turf assembly. The turf underlayment includes a core, a top side having a plurality of top projections, and a bottom side, the top projections forming top side water drainage channels. The panels have edges, with the edges suitable for abutting the edges of adjacent panels, thereby forming a drainage path between adjacent panels. The edges of the panel have vertical support extensions that extend from the panel, the vertical support extensions having an upper surface for supporting an artificial turf assembly overlying the panel. At least one of the panel edges has one or more complementary indentations corresponding to vertical support extensions of adjacent panels, wherein when the panel is assembled with an adjacent panel, the vertical support extensions can be received in indentations in the adjacent panel.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
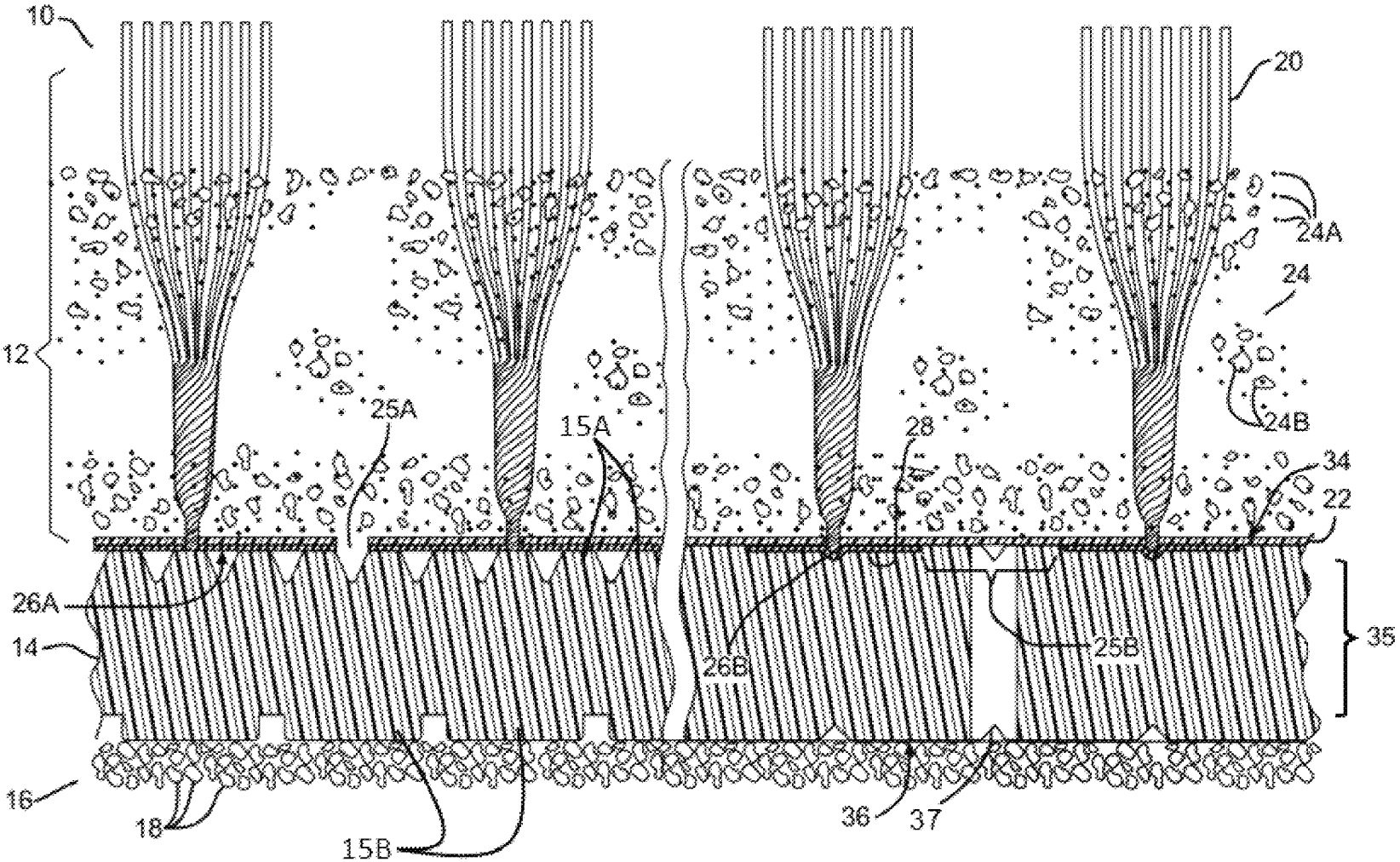
FIG. 1 is a schematic cross-sectional view in elevation of an artificial turf system.

The artificial turf system shown in FIG. 1 is indicated generally at 10. The turf system includes an artificial turf assembly 12, an underlayment layer 14 and a foundation layer 16. The foundation layer 16 can comprise a layer 18 of crushed stone or aggregate, or any other suitable material. Numerous types of foundation layers are known to those skilled in the art. The crushed stone layer 18 can be laid on a foundation base, such as compacted soil, a poured concrete base, or a layer of asphalt paving, not shown. Alternatively, the underlayment layer 14 may be applied over the asphalt or concrete base, omitting the crushed stone layer, if so desired. In many turf systems used for an athletic field, the foundation layers are graded to a contour such that water will drain to the perimeter of the field and no water will pool anywhere on the surface.

The artificial turf assembly 12 includes strands of synthetic grass blades 20 attached to a turf backing 22. An optional infill material 24 may be applied to the grass blades 20. The synthetic grass blades 20 can be made of any material suitable for artificial turf, many examples of which are well known in the art. Typically, the synthetic grass blades are about 5 cm in length although any length can be used. The blades 20 of artificial grass are securely placed or tufted onto the backing 22. One form of blades that can be used is a relatively wide polymer film that is slit or fibrillated into several thinner film blades after the wide film is tufted onto the backing 22. In another form, the blades 20 are relatively thin polymer films (monofilament) that look like individual grass blades without being fibrillated. Both of these can be colored to look like blades of grass and are attached to the backing 22.

The backing layer 22 of the turf assembly 12 is typically water-porous by itself, but is often optionally coated with a water-impervious coating 26A, such as for example urethane, for dimensional stability of the turf. In order to allow water to drain vertically through the backing 22, optionally the backing can be provided with spaced apart holes 25A. In an alternative arrangement, the water impervious coating is either partially applied, or is applied fully and then scraped off in some portions, such as drain portion 25B, to allow water to drain through the backing layer 22. The blades 20 of grass fibers are typically tufted onto the backing 22 in rows that have a regular spacing, such as rows that are spaced about 2 centimeters to about 4 centimeters apart, for example. The incorporation of the grass fibers 20 into the backing layer 22 sometimes results in a series of spaced apart, substantially parallel, urethane coated corrugations or ridges 26B on the bottom surface 28 of the backing layer 22 formed by the grass blade tufts. Ridges 26B can be present even where the fibers are not exposed.

The optional infill material 24 of the turf assembly 12, when applicable, is placed in between the blades 20 of artificial grass and on top of the backing 22. If the infill material 24 is applied, the material volume is typically an amount that covers only a bottom portion of the synthetic grass blades 20 so that the top portions of the blades stick out above the infill material 24. The typical purpose of the optional infill material 24 is to add stability to the field, improve traction between the athlete's shoe and the play surface, and to improve shock attenuation of the field. The infill material 24 is typically sand 24A or ground up rubber particles or synthetic particulate 24B or mixtures of these, although other materials, including natural material, can be used.

When the backing layer 22 has holes 25A or a porous section 25B for water drainage, then some of the infill material 24 is able to wash or filter through the backing layer porous section 25B or the backing layer drainage holes 25A and onto the turf underlayment layer 14. This infill migration, or migration of the infill constituents, is undesirable because the depletion of the infill material 24 results in a field that doesn't have the initially designed stability and firmness characteristics. Excessive migration of the infill material 24, or the infill constituent components, to the turf underlayment layer 14 can create a hard layer which makes the whole turf system less able to absorb impacts.

The turf underlayment layer 14 is comprised of expanded polyolefin foam beads, which can be expanded polypropylene (EPP) or expanded polyethylene (EPE), or any other suitable material. The foam beads are closed cell (water impervious) beads. In one optional method of manufacture, the beads are originally manufactured as tiny solid plastic pellets, which are later processed in a controlled pressure chamber to expand them into larger foam beads having a diameter within the range of from about 2 millimeters to about 5 millimeters. The foam beads are then blown into a closed mold under pressure so they are tightly packed. Finally, steam is used to heat the mold surface so the beads soften and melt together at the interfaces, forming the turf underlayment layer 14 as a solid material that is water impervious.

Other methods of manufacture can be used, such as mixing the beads with an adhesive or glue material to form a slurry. The slurry is then molded to shape and the adhesive cured. The slurry mix underlayment may be porous through the material thickness to drain water away. This porous underlayment structure may also include other drainage features discussed below.

The final EPP material can be made in different densities by starting with a different density bead, or by any other method. The material can also be made in various colors. The resulting underlayment structure, made by either the steam molding or the slurry mixing processes, may be formed as a water impervious underlayment or a porous underlayment. These resulting underlayment layer structures may further include any of the drainage, deflection, and interlocking features discussed below.

Figure 2:
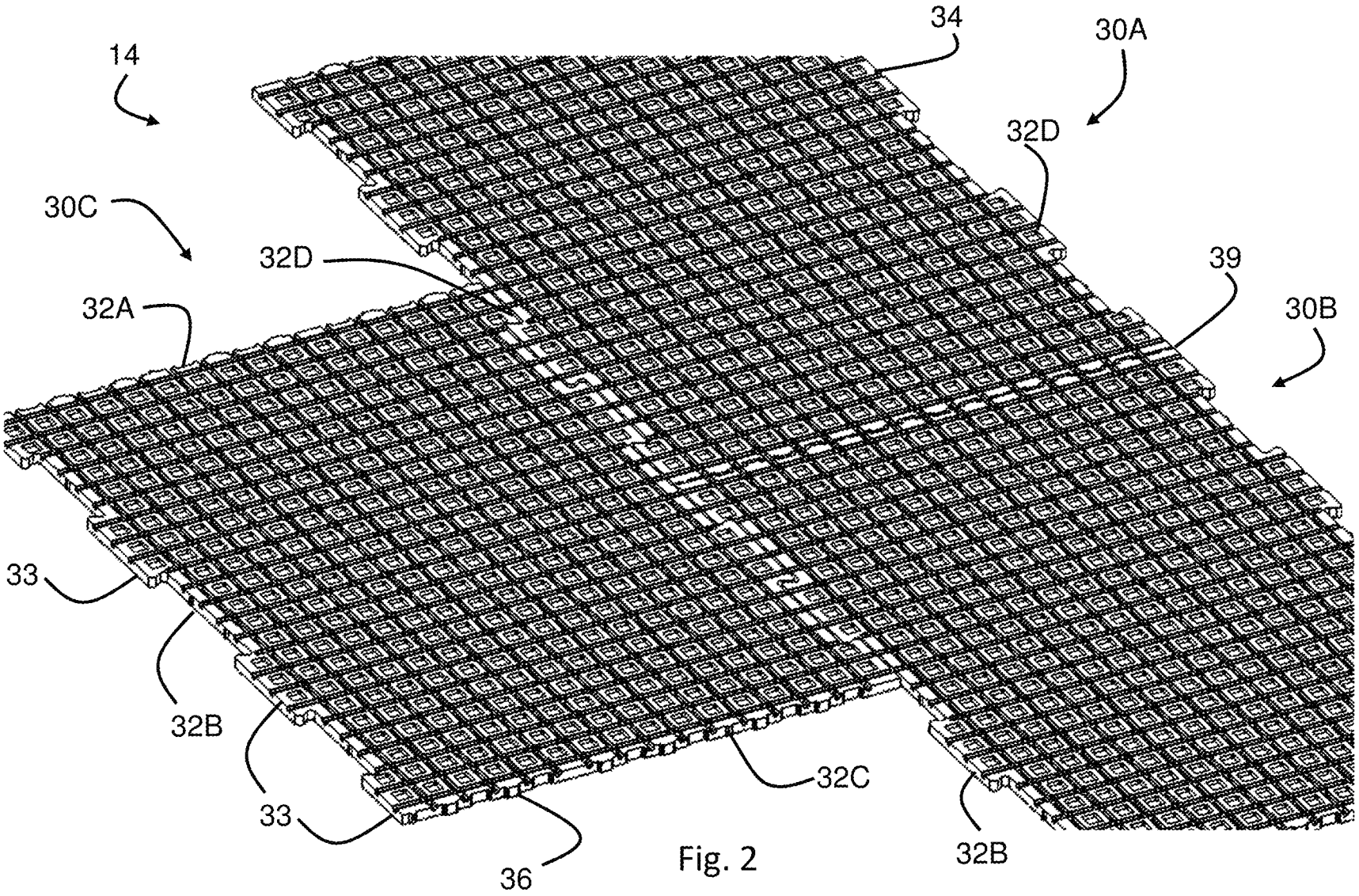
FIG. 2 is a perspective view of a turf underlayment layer for supporting an artificial turf assembly.

In the embodiment illustrated in FIG. 2, the turf underlayment layer 14 is comprised of a plurality of underlayment panels 30A, 30B, and 30C. Though shown as three interlocked panels, it is to be understood that the underlayment layer 14 includes a sufficient number of panels to cover the desired area intended to be covered by the artificial turf surface system 10. Each of the panels has side edges 32A, 32B, 32C, and 32D. Side edges 32B and 32D have a cutout and tab configuration so that the panels 30A, 30B, and 30C can be mated and or interlocked together to form the underlayment layer 14. The side edges 32B and 32D optionally can be configured with dovetail shapes to form an interlocking structure, or can have any other suitable edge configuration. The side edges 32A and 32C are configured to be mated together to form drainage paths 39 when the panels are arranged into a turf underlayment layer 14. The panels 30A, 30B and 30C further have substantially planar major faces, i.e., top side 34 and bottom side 36. Between the top side 34 and the bottom side 36 is the core 35.

Optionally the bottom side 36 includes a plurality of bottom side drainage channels. Also, optionally, the underlayment panel 14 includes drain holes 37 connecting the top side water drainage channels to the bottom side water drainage channels for fluid communication between the panel top side 34 and bottom side 36.

As shown in FIG. 1, the underlayment layer panel includes top projections 15A and optional bottom projections 15B. The thickness of underlayment panel 14 is defined as the thickness of the core 35 of the panel plus the thickness of the top projections 15A plus the thickness of any bottom projections 15B. The top projections 15A support the overlying turf assembly 12 and also define top drainage channels for the flow of water across the panel 14.

Figure 3:
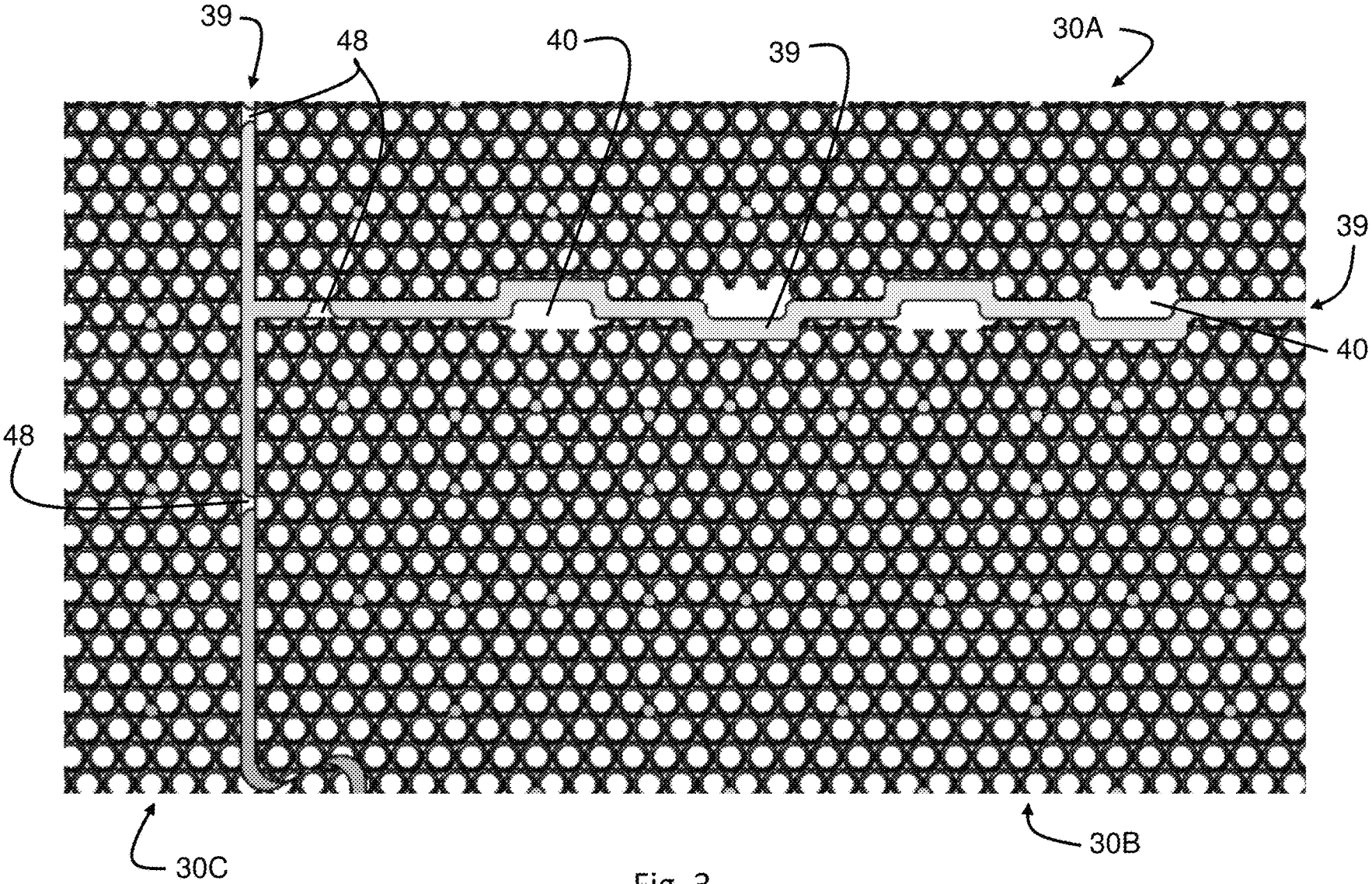
FIG. 3 is a plan view of a portion of the turf underlayment layer of FIG. 2.

As shown in FIGS. 2 and 3, where the edges of one panel, such as panel 30A, abut the edges of an adjacent panel, e.g. 30B, a joint or drainage path 39 is formed. One advantage of the drainage path 39 is to allow the passage of water from the top side 34 of the panel to the bottom side 36 of the panel. In order to prevent the sagging or depression of the turf assembly 12 into the trough or depression of the drainage path 39, vertical support extensions 40 are provided at the edges 32B and 32D of the panels. The vertical support extensions 40 hold up the overlying turf layer and prevent the possibility of having the overlying turf layer from sagging into the valley-like drainage path 39. The use of the vertical support extensions 40 avoids the situation where the outline or pattern of the drainage paths 39 is telegraphed onto the overlying artificial turf layer. The vertical support extensions 40 extend into the drainage paths 39 between adjacent panels.

Figure 4A:
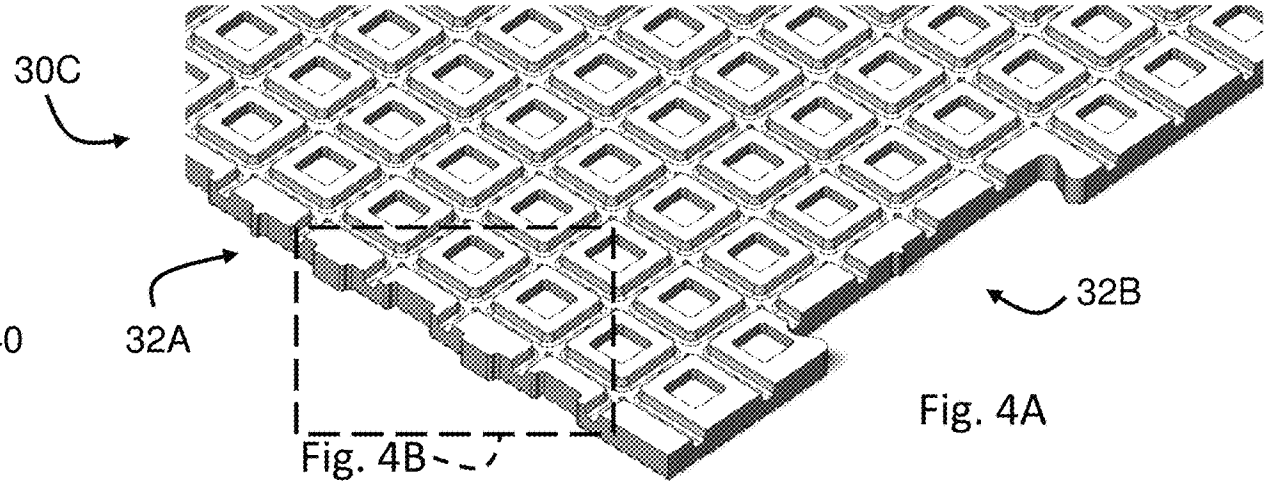
FIG. 4A is a perspective view of a portion of one of the panels.
Figure 4B:
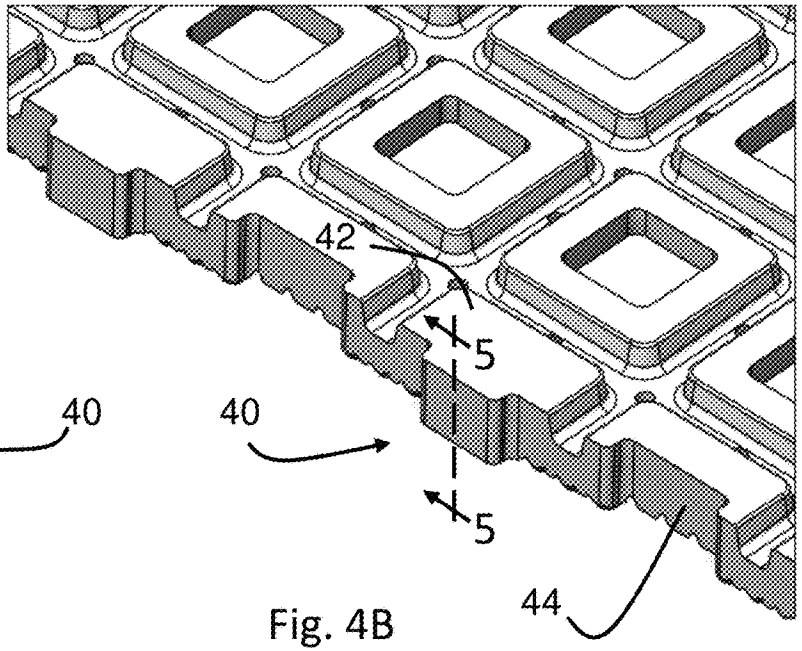
FIG. 4B is a more detailed view of the panel of FIG. 4A.

As shown in FIGS. 4A and 4B, the vertical support extensions 40 have an upper surface 42 for supporting an artificial turf assembly 12 overlying the turf underlayment layer 14. This support for the artificial turf assembly substantially prevents sagging of the artificial turf assembly 12 into the drainage path 39. In order to accommodate thermal expansion and other forces that would tend to move adjacent panels 30A, 30B and 30C toward each other and would then trend to narrow the drainage paths, the panel edges have one or more complementary indentations 44 corresponding to vertical support extensions 40 of adjacent panels. As adjacent panels move toward each other, thereby closing drainage paths between adjacent panels, the vertical support extensions 40 are received in the corresponding indentations 44, and the vertical support extensions 40 substantially do not provide resistance to the movement of the panels toward each other. In the alternative, the vertical support extensions 40 and corresponding indentations 44 could be configured to provide a measured or planned amount of resistance to the movement of the panels toward each other. As can be seen in the embodiment shown in FIG. 3, at least one of the edges of the panels has both vertical support extensions 40 and indentations 44 in the same edge. It is to be understood that there does not need to be a 1 for 1 correspondence between the vertical support extensions and the indentations 44. Some of the vertical support extensions 40 may not have a corresponding indentation in the adjacent panel.

Figure 5:
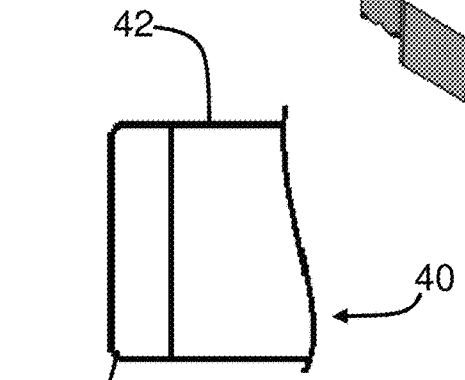
FIG. 5 is a schematic elevational view of the vertical support extension of the panel in FIG. 4A, taken along line 5-5.
Figure 7:
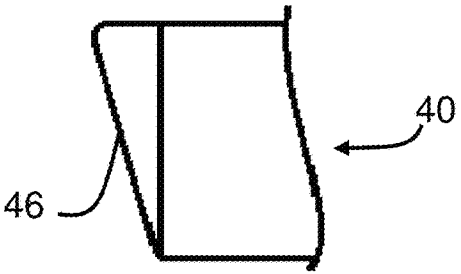
FIG. 7 is a schematic elevation view similar to that of FIG. 6, but showing a tapered vertical support extension.
Figure 6:
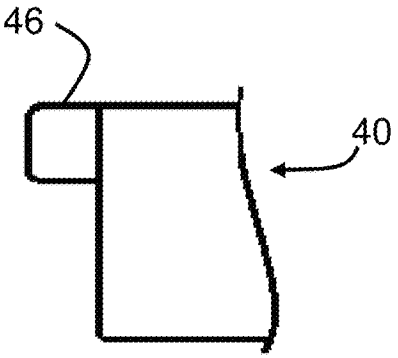
FIG. 6 is a schematic elevation view similar to that of FIG. 5, but showing a cantilevered vertical support extension.

As shown in FIGS. 4A, 4B and 5, the vertical support extensions have an extension portion 46 that extends into the into the drainage path 39. The extension portion 46 can have a top surface shape that is substantially rectangular as shown in FIGS. 4A and 4B. Alternatively, the extension portion 46 can have semicircular top profile when viewed from the top. As shown in FIG. 6, in another embodiment the extension portion can have a cantilevered configuration. Also, the extension portion 46 can have a tapered side profile configuration as shown in FIG. 7. It is to be understood that whatever the shape of the vertical support extension 40 and the extension portion 46, the indentation 44 matches the shape to allow the indentation 44 to receive the vertical support extension 40.

As can be seen in FIGS. 4A, 4B and 5, the vertical support extension has a uniform horizontal cross-sectional area throughout its height. In other embodiments, such as the tapered vertical support extension 40 shown in FIG. 7, there is a non-uniform horizontal cross-sectional area throughout the height of the vertical support extension. In the case of the tapered vertical support extension shown in FIG. 7, there is a greater horizontal cross-sectional area at the upper end of the vertical support extension 40 than at the lower end.

An optional feature of the underlayment panels is one or more drainage projections 48 that extends from the edge of the panels 32A, 32B, 32C, and 32D. The drainage projections 48 maintain the separation of adjacent panels from each other, thereby helping to define the width of the drainage path 39. The drainage projections are crushable so that they can accommodate movement of adjacent panels toward each other when caused by thermal expansion or other forces or mechanisms. In contrast to the vertical support extensions 40, the drainage projections 48 do not have corresponding recesses 44 in the adjacent panel.

Figure 8:
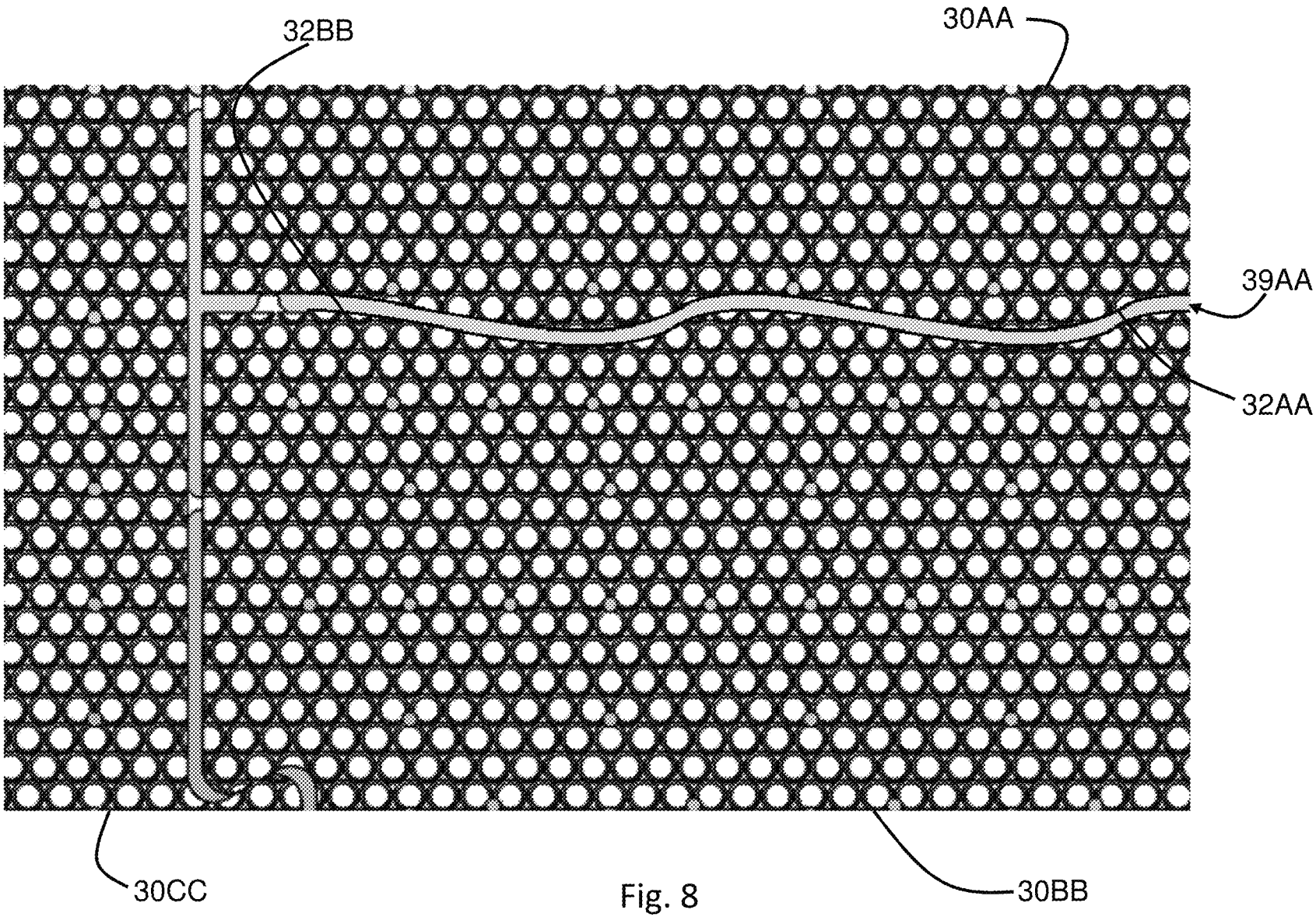
FIG. 8 is a plan view similar to that of FIG. 3, but showing a non-linear drainage channel.

There is another mechanism that can be used to support the turf assembly 12 and prevent it from sagging or dropping into the drainage path. As shown in FIG. 8, the edges 32AA and 32CC of panels 30AA and 30BB are non-linear. The result of non-linear panel edges is a non-linear drainage path 39AA that can provide support for the turf assembly 12 without the use of the vertical support extensions 40. It is to be understood that vertical support extensions can also be used with a non-linear drainage channel. The shape of the non-linear edge can be any shape suitable for supporting the overlying turf assembly 12. In one embodiment, the non-linear panel edges are wavy, making the drainage paths 39AA wavy. In another embodiment, the panel edges have a non-linear shape, with the non-linear shape of the panel edges being complementary to the non-linear, non-interlocking shape of adjacent panel edges.

The principle and mode of operation of this invention have been explained and illustrated in its preferred embodiment. However, it must be understood that this invention may be practiced otherwise than as specifically explained and illustrated without departing from its spirit or scope.

The invention claimed is:

1. A turf underlayment layer for supporting an artificial turf assembly, the turf underlayment layer comprising a plurality of panels assembled together, each panel including a top side configured to support the artificial turf assembly overlying the turf underlayment layer, a bottom side, and edges defining a seam with abutting panel edges, at least one of the panel edges including at least one vertical support extension having an upper surface that is coplanar with the top side of the panel and defining a non-linear segment of the seam between adjacent panels, and the abutting panel including at least one complementary indentation corresponding to and receiving the at least one vertical support extension, the edges of panels forming the seam are spaced apart from each other to permit relative panel movement parallel to and perpendicular to the top side and to permit water to pass from the top surface to the bottom surface, the panels being made from a plurality of polyolefin beads bonded together by at least one of pressure and heat to produce a substantially water-impervious surface.

2. The turf underlayment layer of claim 1 wherein the at least one vertical support extension and the at least one complementary indentation are configured as mating curved edges.

3. The turf underlayment layer of claim 2 wherein the curved edges have one or more drainage projections spacing abutting panel edges apart to form a drainage path therebetween, the drainage projections being compressible to absorb relative movement of abutting panels.

4. The turf underlayment layer of claim 3 wherein the drainage projections elastically deflect to absorb relative movement of adjacent panels and return to a generally undeflected condition after the deflection load is removed.

5. The turf underlayment layer of claim 1 wherein the panels each define a core between the top side and the bottom side, the core having a plurality of drain holes connecting the top side to the bottom side for fluid communication between the panel top side and the panel bottom side.

6. The turf underlayment layer of claim 1 in which the vertical support extensions have a uniform horizontal cross-sectional area throughout a height of the vertical support extensions.

7. The turf underlayment layer of claim 1 in which the vertical support extensions have a non-uniform horizontal cross-sectional area throughout a height of the vertical support extensions.

8. The turf underlayment layer of claim 1 in which the vertical support extensions are tapered, having a greater horizontal cross-sectional area at an upper end.

9. The turf underlayment layer of claim 1 in which the vertical support extensions are cantilevered.

10. The turf underlayment panel of claim 1 wherein the top side includes a plurality of projections defining drainage channels and the projections extend across the upper surface of the at least one vertical support extension.

11. The turf underlayment panel of claim 10 wherein the bottom side includes a plurality of projections defining drainage channels.

12. A turf underlayment layer for supporting an artificial turf assembly, the turf underlayment layer comprising a plurality of panels assembled together, each panel including a top side configured to support the artificial turf assembly overlying the turf underlayment layer, a bottom side, and edges defining a seam with abutting panel edges, at least one of the panel edges including at least one vertical support extension having an upper surface that is coplanar with the top side of the panel and defining a non-linear segment of the seam between adjacent panels, and the abutting panel including at least one complementary indentation corresponding to and receiving the at least one vertical support extension, the at least one vertical support extension and the at least one complementary indentation are configured as a tab and a cutout dovetail joint that limits relative panel movement parallel with the top surface and unrestricted relative panel movement perpendicular to the top surface, the panels being made from a plurality of polyolefin beads bonded together by at least one of pressure and heat to produce a substantially water-impervious surface.

13. The turf underlayment layer of claim 12 wherein the edges of panels forming the seam are in contact with each other.

14. The turf underlayment panel of claim 12 wherein one of the top surface or the bottom surface includes a plurality of projections defining drainage channels.

15. A turf underlayment layer for supporting an artificial turf assembly, the turf underlayment layer comprising a plurality of panels assembled together, each panel including a top side configured to support the artificial turf assembly overlying the turf underlayment layer, a bottom side, and edges defining a seam with abutting panel edges, at least one of the panel edges including at least one vertical support extension having an upper surface that is coplanar with the top side of the panel and defining a non-linear segment of the seam between adjacent panels, and the abutting panel including at least one complementary indentation corresponding to and receiving the at least one vertical support extension, the edges of panels forming the seam are spaced apart from each other to permit relative panel movement parallel to and perpendicular to the top side, and the seam is a spaced apart drainage path to permit water to flow from the top side of the panels to the bottom side of the panels, and the at least one of the panel edges includes dovetail shapes to form an interlocking structure that restricts movement of the panels during an initial assembly stage in the parallel direction to the top side and permits movement of the panels caused by a thermal input, the panels being made from a plurality of polyolefin beads bonded together by at least one of pressure and heat to produce a substantially water-impervious surface.

16. The turf underlayment layer of claim 15 wherein the top side of the panels includes a plurality of drainage channels that direct water flow toward the seam.

17. The turf underlayment layer of claim 16 wherein the top side of the panels includes projections that define the drainage channels.

18. The turf underlayment layer of claim 17 wherein the bottom side of the panels includes a plurality of bottom side drainage channels.

19. The turf underlayment panel of claim 15 wherein the top side includes a plurality of projections defining drainage channels that intersect with the spaced apart panel edges.

20. The turf underlayment panel of claim 15 wherein the bottom side includes a plurality of projections defining drainage channels that intersect with the spaced apart panel edges.

* * * * *